US012173450B2

(12) United States Patent
Falkner et al.

(10) Patent No.: US 12,173,450 B2
(45) Date of Patent: Dec. 24, 2024

(54) BRAIDING, WINDING OR SPIRALLING MACHINE AND METHOD FOR OPERATING SAME

(71) Applicant: MASCHINENFABRIK NIEHOFF GMBH & CO. KG, Schwabach (DE)

(72) Inventors: Thomas Falkner, Schwabach (DE); Stephan Gorgels, Schwabach (DE); Markus Raab, Wolframs-Eschenbach (DE)

(73) Assignee: MASCHINENFABRIK NIEHOFF GMBH & CO. KG, Schwabach (DE)

( * ) Notice: Subject to any disclaimer, the term of this patent is extended or adjusted under 35 U.S.C. 154(b) by 398 days.

(21) Appl. No.: 17/627,492

(22) PCT Filed: Jul. 3, 2020

(86) PCT No.: PCT/EP2020/068771
§ 371 (c)(1),
(2) Date: Jan. 14, 2022

(87) PCT Pub. No.: WO2021/013500
PCT Pub. Date: Jan. 28, 2021

(65) Prior Publication Data

US 2022/0259801 A1 Aug. 18, 2022

(30) Foreign Application Priority Data

Jul. 25, 2019 (DE) ..... 102019211030.4

(51) Int. Cl.
*D07B 7/02* (2006.01)
*D04C 1/12* (2006.01)
(Continued)

(52) U.S. Cl.
CPC ..... *D07B 7/022* (2013.01); *D04C 1/12* (2013.01); *D04C 3/42* (2013.01); *D07B 5/005* (2013.01);
(Continued)

(58) Field of Classification Search
CPC ..... D07B 5/005; D07B 7/022; D07B 7/14; D07B 2201/2089; D07B 2201/209;
(Continued)

(56) References Cited

U.S. PATENT DOCUMENTS 3,808,078 A 4/1974 Snellman et al.

FOREIGN PATENT DOCUMENTS

CN 206477109 9/2017
DE 2162170 6/1973
(Continued)

OTHER PUBLICATIONS

Machine Translation of JP S6266922A, provided by Espacenet Patent Translate on Apr. 9, 2024 (Year: 2024).*
(Continued)

*Primary Examiner* — Jocelyn Bravo
(74) *Attorney, Agent, or Firm* — Sheridan Ross P.C.

(57) ABSTRACT

The invention relates to a method for operating a braiding, winding or spiraling machine for braiding around, wrapping around or spiraling around a strand-like material, in particular a cable, with at least one elongate material strand formed from at least one elongate material fibre, in particular from at least one wire. In the method, a diameter of the strand-like material is measured and a feed rate of the strand-like material and/or a rotational speed at which the at least one elongate material strand moves about the longitudinal axis of the strand-like material is controlled by open-loop or closed-loop control depending on said diameter measured. A predefined degree of coverage of the strand-like material by
(Continued)

the at least one elongate material strand can be kept substantially constant by means of an open-loop or closed-loop control of the relative feed rate of the strand-like material depending on the diameter measured.

7 Claims, 2 Drawing Sheets

(51) Int. Cl.
*D04C 3/42* (2006.01)
*D07B 5/00* (2006.01)
*D07B 7/14* (2006.01)

(52) U.S. Cl.
CPC ..... *D07B 7/14* (2013.01); *D07B 2201/2089* (2013.01); *D07B 2201/209* (2013.01); *D07B 2301/25* (2013.01); *D07B 2301/3591* (2013.01); *D07B 2501/406* (2013.01)

(58) Field of Classification Search
CPC ..... D07B 2301/25; D07B 2301/3591; D07B 2501/406; D04C 1/12; D04C 3/42
USPC ..... 87/8
See application file for complete search history.

(56) References Cited

FOREIGN PATENT DOCUMENTS

| | | |
|---|---|---|
| DE | 19713706 | 10/1998 |
| DE | 19837172 | 2/2000 |
| GB | 143019 | 5/1920 |
| JP | S62-66922 | 3/1987 |
| JP | H04-185750 | 7/1992 |
| JP | H07-133566 | 5/1995 |
| JP | 2009-46206 | 3/2009 |
| WO | WO 2017/022418 | 2/2017 |

OTHER PUBLICATIONS

Official Action with English Translation for China Patent Application No. 202080050522.6, dated Jan. 18, 2023, 12 pages.
Official Action with Machine Translation for Japan Patent Application No. 2022-504677, dated Feb. 26, 2024, 8 pages.
International Search Report and Written Opinion for International (PCT) Patent Application No. PT/EP2020/068771, dated Aug. 20, 2020, 10 pages.
English Translation of the International Search Report for International (PCT) Patent Application No. PCT/EP2020/068771, dated Aug. 20, 2020, 2 pages.

* cited by examiner

BRAIDING, WINDING OR SPIRALLING MACHINE AND METHOD FOR OPERATING SAME

CROSS REFERENCE TO RELATED APPLICATIONS

This application is a national stage application under 35 U.S.C. 371 and claims the benefit of PCT Application No. PCT/EP2020/068771 having an international filing date of 3 Jul. 2020, which designated the United States, which PCT application claimed the benefit of German Patent Application No. 10 2019 211 030 4 filed 25 Jul. 2019 the disclosures of ach of which are incorporated herein by reference in their entireties.

FILED OF THE INVENTION

The invention relates to a braiding, winding or spiraling machine and a method for operating same.

SUMMARY

Braiding machines, in particular rotary braiding machines, can be used to produce hollow tubular braids from an elongate material to be processed.

An elongate material is thereby to be understood as an elongated strand-like material preferably available in virtually any desired length. A strand of the elongate material can consist of one or more individual elongate material fibers. An elongate material fiber can in particular, but not exclusively, be a wire which may contain iron but preferentially consists of non-ferrous metals, or a textile fiber, a carbon fiber or another strand-like carbon material. An elongate material fiber can thus in particular be a metal wire, a yarn or a plastic fiber. The number of elongate material fibers contained in an elongate material strand is also referred to as the fold number. For example, a strand of 10 individual wires has a fold number of 10.

One application for such hollow tubular braids is medical braids for vascular implants, e.g. stents or vascular prostheses.

Braiding machines can however also be used to braid an elongate material around a likewise strand-like material, for example braiding a wire mesh around a cable. The strand-like material thereby preferably has a cross section substantially perpendicular to its longitudinal axis, which is substantially round.

The present invention relates to this second application of braiding machines for braiding around a strand-like material.

Example areas of application for thusly produced braided strand-like materials include electrical cables provided with shielding against electromagnetic fields, cables or hoses provided with protective enclosures against mechanical loads, or molded bodies braided with carbon fibers or other strand-like carbon materials, which may possibly be removed again after the carbon material has hardened, for the production of low-mass components, especially in lightweight construction.

During operation of a braiding machine, multiple strands of the elongate material to be braided are wrapped at a specific angle around the strand-like material to be braided from opposite directions, thereby crossing over each other pursuant to a specific pattern and thus interweaving, while the strand-like material advances forward. In doing so, the desired braiding is formed on the surface of the strand-like material. Preferably, the braided strand-like material is directed onto a disk with a circumferential end face groove, the so-called haul-off capstan, and from there removed from the braiding machine.

The aforementioned angle, the so-called twist angle, is defined as an angle between a half-line running parallel to the longitudinal axis of the strand-like material and opposite to the direction of movement of the strand-like material through the elongate material take-up point on the strand-like material and the elongate material being taken up on the strand-like material. The twist angle can for example have a value of 50 degrees.

Winding machines are similar in function to braiding machines; the difference being that the strands of the elongate material to be processed are not interwoven but rather lie loosely atop one another or on the strand-like material to be wrapped respectively. Winding machines can apply one or more wrapped layers to the strand-like material to be wrapped.

Winding machines are used for example to produce cords or ropes, shieldings for hoses or cables, or reinforcements for pressure hoses.

Spiraling machines largely correspond in function to winding machines, whereby the elongate material to be processed is preferably plastically deformable and thus forms a self-supporting spiral when wound around the strand-like material to be wrapped. Spiraling machines are for example used for sheathing cables with copper wires or soft steel wires as spiral coils.

What all the machines considered have in common is that during their operation, at least one elongate material strand is repeatedly guided around the longitudinal axis of the strand-like material and the strand-like material is simultaneously always moved in the same direction substantially in the direction of its longitudinal axis. By so doing, the at least one elongate material strand takes on the shape of a coil looping around the strand-like material.

The invention will be described below using the example of a braiding machine for wire being the elongate material used to braid and a cable being the strand-like material to be braided; i.e. for producing a cable surrounded by a wire mesh. This does not, however, constitute any limitation; the invention can be used for a braiding, winding or spiraling machine for braiding any given strand-like material via any given elongate material.

Braiding machines of the type described are known from the prior art. For example, DE 21 62 170 A1 makes known a high-speed braiding machine for braiding a fibrous elongate material in the form of wires or strips made of organic or non-organic material around strand-like material using bobbin carriers which counter-rotate in two parallel planes.

The problem encountered during braiding machine operation is that the strand-like material to be braided is not completely homogeneous in nature due to imperfections or unavoidable manufacturing tolerances. In particular, the diameter of the strand-like material, as viewed over its longitudinal extension, is subject to fluctuations. "Diameter" thereby always means a diameter of a cross section of the strand-like material substantially perpendicular to its longitudinal axis.

One problem that can arise from a varying strand-like material diameter is an equally varying degree of coverage of the strand-like material by the elongate material.

The degree of coverage (also referred to as "coverage coefficient") is defined as a ratio of the total surface area of all the elongate material strands facing radially outward with respect to the strand-like material covering the strand-like material in a specific section of said strand-like material to the surface area of the strand-like material in said section. It is thereby assumed that when an elongate material strand consists of multiple elongate material fibers, the individual elongate material fibers are laid down next to one another on the strand-like material without any distance between each other so that the elongate material strand forms a "band" of a specific width on the surface of the strand-like material in the braided state. The width of this band thereby corresponds to the number of elongate material fibers in the elongate material strand; i.e. the fold number, multiplied by the diameter of the individual elongate material fibers. Furthermore assumed is that all the elongate material fibers in an elongate material strand are of the same diameter, in particular are even identical.

The thusly defined degree of coverage indicates how many elongate material strands lie atop one another on average at a specific point on the surface of the finished product; i.e. the braided strand-like material.

Only a certain portion of the braided elongate material strands can also be factored into the degree of coverage where applicable. Generally speaking, for example, the same number of bobbins from which strand-like material unwinds rotate in mutually opposite directions in a braiding machine. Only the bobbins rotating in e.g. one of the two directions might then be taken into account for the degree of coverage; i.e. only half the number of bobbins used in total and thus also only half the number of total braided elongate material strands.

A degree of coverage of 1 thus means that on the whole (on average), the windings of the individual elongate material strands in the braided strand-like material lie adjacent one another on the surface of the strand-like material without any gaps. In contrast, a 0.85 degree of coverage means that there are gaps between the windings of the individual elongate material strands in the braided strand-like material, their width corresponding on average to 0.15 times the width of an elongate material strand. In turn, a 1.15 degree of coverage means that, on average, the windings of the individual elongate material strands in the braided strand-like material overlap to 0.15 times their width.

A certain degree of coverage is generally specified for a product to be manufactured, same depending on the required mechanical, electrical or other physical properties or on the required appearance of the desired product, for instance its shielding properties or its compressive strength. Should the product's actual degree of coverage be less than the predefined value, this can result in falling short of the required properties of the product and thus the required product quality. On the other hand, should the product's actual degree of coverage be higher than the predefined value, this can likewise lead to quality problems, particularly though also in terms of using more strand-like material than necessary during production and thus the production costs of the product being higher than necessary.

In the braiding machines from the prior art, however, there is no possibility of factoring in changes in the diameter of the strand-like material during its braiding. In particular, deviations in the degree of braided strand-like material coverage from a predefined degree of coverage simply need to be accepted with prior art braiding machines.

The present invention is thus based on the task of specifying a method for operating a braiding, winding or spiraling machine and a corresponding braiding, winding or spiraling machine able to take changes in the diameter of the strand-like material into account.

This task is solved by a method for operating a braiding, winding or spiraling machine according to claim 1, respectively by a braiding, winding or spiraling machine according to claim 6. Advantageous further developments of the invention are set forth in the subclaims.

In the inventive method for operating a braiding, winding or spiraling machine for braiding, wrapping or spiraling at least one elongate material strand formed from at least one elongate material fiber, in particular from at least one wire, around a strand-like material, in particular a cable, the at least one elongate material strand is rotationally fixed at least at one point to the strand-like material. The at least one elongate material strand is then repeatedly guided around the longitudinal axis of the strand-like material and the strand-like material simultaneously always moved in the same direction substantially in the direction of its longitudinal axis. By so doing, the at least one elongate material strand takes on the shape of a coil looping around the strand-like material.

According to the invention, a diameter of a cross section of the strand-like material is measured substantially perpendicular to its longitudinal axis. Depending on the diameter measured, a feed rate of the strand-like material and/or a rotational speed at which the at least one elongate material strand moves around the longitudinal axis of the strand-like material is then controlled or regulated. The feed rate of the strand-like material is thereby the speed at which the strand-like material is always moved in the same direction substantially in the direction of its longitudinal axis.

The feed rate of the strand-like material and the rotational speed of the at least one elongate material strand have proven to be the most suitable operating parameters of the braiding machine in that their control or regulation enables appropriately taking changes in the diameter of the strand-like material into account.

For example, upon an increase in the diameter of the strand-like material, a greater length of the elongate material must also be provided for a single revolution of the elongate material strand. This also means that the bobbins from which the elongate material unwind need to rotate faster. This can lead to problems if the pay-off speed of the elongate material from the bobbins becomes too high as to enable elongate material breakage. In this case, the invention allows the feed rate of the strand-like material and/or the rotational speed of the at least one elongate material strand to be reduced to the extent of preventing the risk of elongate material breakage.

In one preferential embodiment of the invention, a relative feed rate of the strand-like material is controlled or regulated as a function of the measured diameter of the cross section of the strand-like material such that a degree of coverage of the strand-like material by the at least one elongate material strand substantially corresponds to a predefined value. This thereby enables fulfilling specified quality requirements for the product to be manufactured while simultaneously consuming no more elongate material than necessary.

The relative feed rate of the strand-like material is thereby defined as a distance by which the strand-like material moves around the longitudinal axis of the strand-like material in one complete revolution of the at least one elongate material strand. This distance is also referred to as the pitch or lay length.

The degree of coverage of the strand-like material by the at least one elongate material strand has already been defined above.

In this embodiment of the invention, the braiding machine's two drive speeds are thus not controlled or regulated independently of each other but rather only in relation to one another, whereby a specific relative feed rate of the strand-like material is achieved. This can for instance ensue by controlling or regulating both drive speeds to specific predefined values, the ratio of which yields the desired relative speed. The predefined values of the two drive speeds are thereby preferably selected such that neither of the two drive speeds exceeds the respectively permissible maximum speed. The desired relative speed can, however, also be achieved by maintaining the current value of one of the two drive speeds and changing the value of the other drive speed until the ratio of the two drive speeds yields the desired relative speed.

This implementation of the invention is based on the observation of the degree of coverage being able to be expressed precisely by the above-mentioned relative speed and the diameter of the strand-like material (as well as several constant factors).

This relationship is derived mathematically in the following, wherein:

- h is the relative feed rate of the strand-like material,
- D the diameter of the strand-like material,
- k the degree of coverage,
- f the number of elongate material fibers in an elongate material strand (fold number),
- d the diameter of an elongate material fiber,
- X the number of elongate material strands to be factored into the degree of coverage,
- b the width of the "band" formed by an elongate material strand, and
- S the length of an elongate material strand section forming one revolution on the surface of the strand-like material.

With reference to FIG. 1, a "pay-off" of the surface of the strand-like material 7 is considered on a section exhibiting a length corresponding to the distance by which the strand-like material advances in one revolution of the elongate material strand around the strand-like material 9; i.e. a rectangular pay-off of the strand-like material surface (bold-bordered in FIG. 1) of height h, width π·D, and thus area h·πD.

During operation of the braiding machine, a likewise rectangular area of a section of the "band" formed by an elongate material strand 9 of width S and height b, and thus area b·S, is wound onto this rectangular pay-off of strand-like material. In so doing, the rectangular area of the elongate material strand 9 does not come to lie exactly atop the rectangular pay-off of the strand-like material but rather the two rectangular areas overlap one another. However, these overlaps balance each other out such that the ratio defining the degree of coverage precisely corresponds to the area ratio of the two rectangular areas.

The width S of the rectangular area of elongate material strand 9 forms the diagonal of the rectangular pay-off of the strand-like material 7; i.e. pursuant to the Pythagorean theorem:

$$S=\sqrt{h^2+(\pi D)^2}.$$

In FIG. 1, the width b of the band formed by the elongate material strand 9 is precisely selected to be just large enough that the bands of successive revolutions adjoin each other seamlessly; i.e. FIG. 1 yields a degree of coverage of k=1.

As stated above, the width b of the band formed by the elongate material strand corresponds to the number of elongate material fibers in the elongate material strand multiplied by the diameter of the individual elongate material fibers (see FIG. 1); thus b=f·d.

The degree of coverage is then yielded as the ratio of the two indicated rectangular areas multiplied by the number X of elongate material strands to be taken into account; i.e.

$$k=\frac{X\cdot b\cdot S}{h\cdot\pi D}=\frac{X\cdot f\cdot d\cdot\sqrt{h^2+(\pi D)^2}}{h\cdot\pi D}.$$

Solving this equation for h produces:

$$h=\frac{\pi D}{\sqrt{\left(\frac{k\pi D}{fXd}\right)^2-1}}$$

or through further reformulating:

$$h=\frac{1}{\sqrt{\left(\frac{k}{fXd}\right)^2-\frac{1}{(\pi D)^2}}}.$$

In a particularly preferential implementation of the invention, the just noted relationship is therefore used to control or regulate the relative feed rate of the strand-like material. The measured diameter D, the predefined degree of coverage k as well as constants f, X and d are thereby known, from which the relative feed rate h of the strand-like material can be calculated and used as a target variable for the control or regulation of the braiding machine. This ensures that—aside from erroneous diameter D measurements and relative feed rate h control or regulation—the finished product exhibits the given degree of coverage k.

The second expression for h given above further shows that h decreases strictly monotonically with increasing ID, i.e. as D gets larger, h becomes smaller, and as D becomes smaller, h gets larger.

In one further preferential implementation of the invention, the above-defined twist angle is additionally measured and used in controlling or regulating the relative feed rate of the strand-like material. The control or regulation of the relative feed rate of the strand-like material. can thereby ensue in such a way that a target variable is determined for the twist angle and the twist angle also changed by changing the relative feed rate simultaneously with measuring the twist angle until it reaches its target variable.

In the following, α denotes the twist angle. Thus, as evident from FIG. 1:

$$\tan\alpha=\frac{\pi D}{h}$$

and thereby the first expression indicated above for h:

$$\alpha=\tan^{-1}\sqrt{\left(\frac{k\pi D}{fXd}\right)^2-1}.$$

In a particularly preferential implementation of the invention, the just noted relationship is therefore used to control or regulate the relative feed rate of the strand-like material. The measured diameter D, the predefined degree of coverage k as well as constants f, X and d are thereby known, from which the twist angle α can be calculated and used as a target variable for the control or regulation of the braiding machine. This ensures that—aside from erroneous diameter D measurements and relative feed rate h control or regulation using the twist angle α—the finished product exhibits the given degree of coverage k.

The invention further relates to a braiding, winding or spiraling machine configured to be operated according to an inventive method for braiding, wrapping or respectively spiraling at least one elongate material strand made from at least one elongate material fiber, in particular from at least one wire, around a strand-like material, in particular a cable, and configured to repeatedly guide the at least one elongate material strand around the longitudinal axis of the strand-like material and simultaneously always move the strand-like material in the same direction substantially in the direction of its longitudinal axis.

The inventive braiding, winding or spiraling machine comprises a measuring apparatus for a diameter of a cross section of the strand-like material substantially perpendicular to its longitudinal axis and a control or regulating apparatus for controlling or regulating a relative feed rate of the strand-like material, defined as a distance by which the strand-like material moves upon a complete revolution of the at least one elongate material strand around the longitudinal axis of the strand-like material subject to said measured diameter.

In one preferential implementation, the inventive braiding, winding or spiraling machine is designed to be operated according to an inventive method using the angle of twist to control or regulate the relative feed rate of the strand-like material and to that end further comprises a measuring apparatus for the twist angle.

Further advantages, features and possible applications of the present invention will become apparent from the following description in conjunction with the figures.

BRIEF DESCRIPTION OF THE DRAWINGS

Shown are:

FIG. 1 has already been explained above.

FIG. 2 shows the functional principle of an inventive braiding machine 1 on the basis of a schematic drawing.

DETAILED DESCRIPTION

Figure 1:
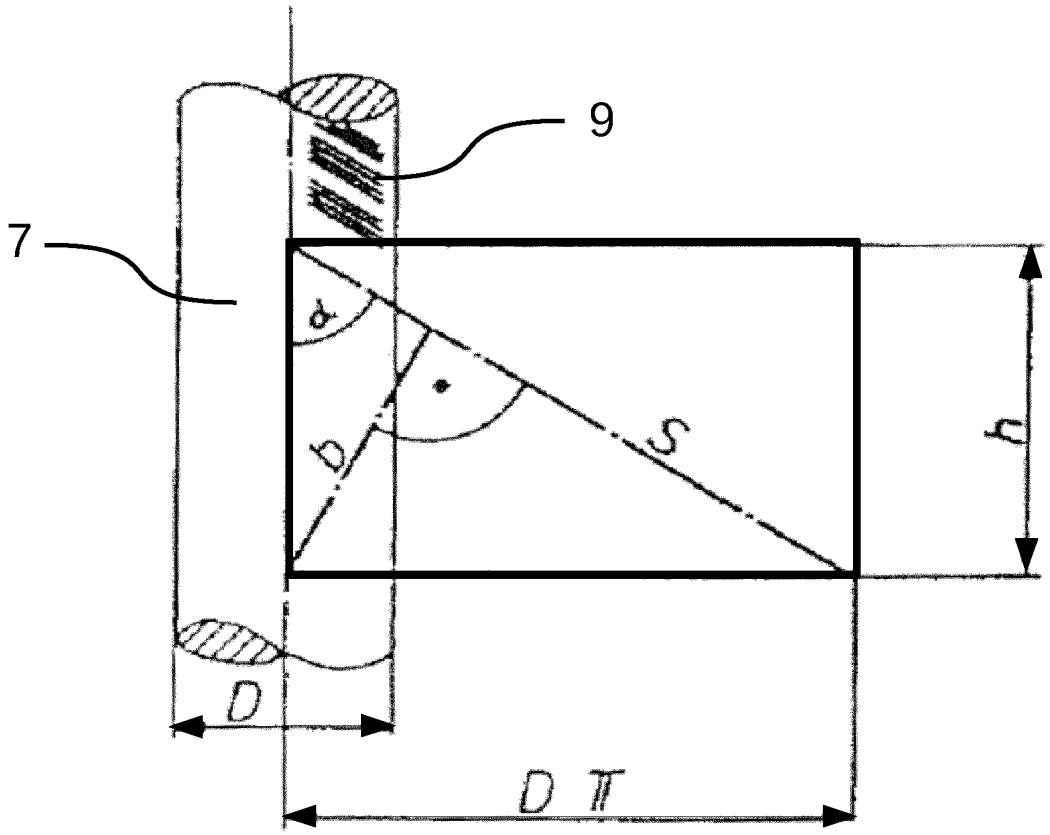
FIG. 1: a drawing of a rectangular "pay-off" of the surface of the strand-like material.
Figure 2:
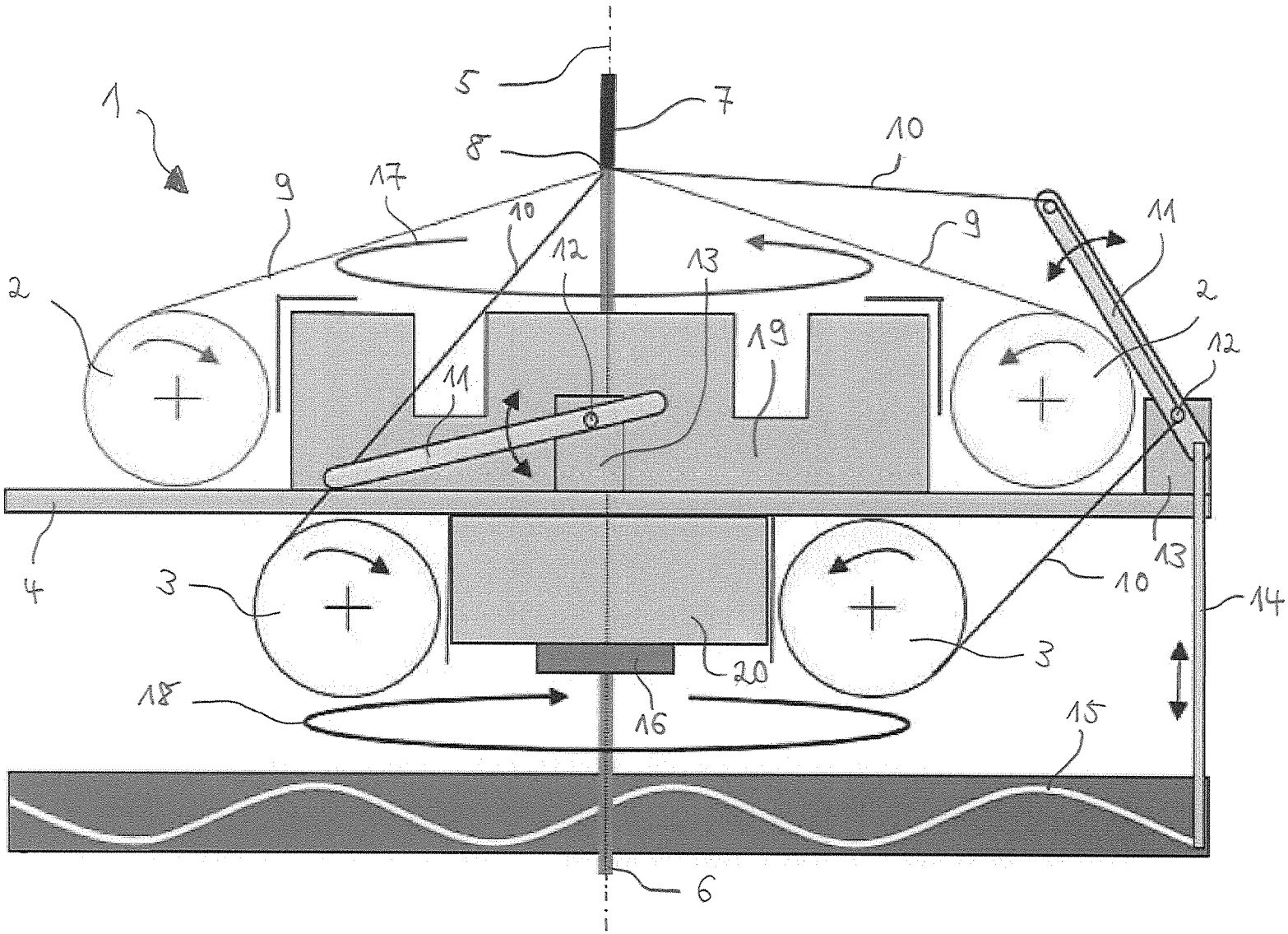
FIG. 2: a schematic configuration of a braiding machine of the type under consideration.

The braiding machine 1 comprises a number, for example 8, 12 or 16, of upper braiding bobbins 2, onto each of which an upper yarn 9 (the so-called weft) is wound. The upper yarn 9 can in particular be a textile strand, a wire or a bundle of several such textile strands or wires. The upper braiding bobbins 2 are mounted on bobbin carriers (not shown) which rotate separately from each other on gearwheels on a ring gear (neither shown) mounted on a lower bobbin rail 4 and all rotate in the same direction, for example counterclockwise (indicated by upper rotating arrow 17).

Furthermore, the braiding machine 1 comprises a number, for example likewise 8, 12 or 16, of lower braiding bobbins 3, onto each of which a lower yarn 10 (the so-called warp) is wound. The number of lower braiding bobbins 3 is thereby preferably the same as the number of upper braiding bobbins 2. The lower yarn 10 is preferably the same yarn as the upper yarn 9. The lower braiding bobbins 3 are mounted on a common lower bobbin rail 4 which rotates in a direction opposite to the upper braiding bobbins 2, for example clockwise (indicated by lower rotating arrow 18).

The axis around which the upper braiding bobbins 2 and lower braiding bobbins 3 rotate together albeit in opposite directions coincides with the so-called braid axis 5. A cable 6—still unshielded at this point—is introduced into the braiding machine 1 along the braid axis 5 from below and continues on out of the braiding machine 1 at the upper end thereof.

The upper yarns 9 paying off the upper braiding bobbins 2 and the lower yarns 10 paying off the lower braiding bobbins 3 converge at braiding point 8 on the braid axis 5 and wrap around the unshielded cable 6 there, which is then pulled off the upper end of the braiding machine 1 as a shielded cable 7 by a (not shown) haul-off capstan.

So that the upper yarns 9 and the lower yarns 10 cross at braiding point 8 and are thereby braided, the lower yarns 10, which rotate with lower braiding bobbins 3 in the opposite direction about braid axis 5 than upper yarns 9 with upper braiding bobbins 2, are alternatingly passed over one or more adjacent upper braiding bobbins 2 and under one or more adjacent upper braiding bobbins 2, for example above or respectively below two adjacent upper braiding bobbins 2. During the up and down bobbing motion, each lower yarn 10 dips into vertical slots in an upper inner housing 19.

The lower yarn 10 runs over a roller at one end of a braiding lever 11 and is alternatingly lifted or depressed by the braiding lever 11 prior to passing an "oncoming" upper bobbin 2 and thus passed over the upper braiding bobbin 2 or under the upper braiding bobbin 2 respectively. To this end, each lower yarn 10 is allocated its own braiding lever 11 respectively rotatable about a pivot bearing 12 fixed to a mount 13 connected to the lower bobbin rail 4.

Each braiding lever 11 is controllable via a connecting rod 14, the upper end of which is rotatably connected to the braiding lever 11 and the lower end of which runs in a fixed circumferential curved path of a cam control 15. The waveform of the cam control 15 curved path results in an up and down sliding movement of the connecting rod 14 and thus to the desired up and down tilting of the braiding lever 11, which is synchronized with the movement of the upper braiding bobbins 2. Alternatively, however, the braiding lever 11 can also be directly guided in the curved path of the cam control 15.

A diameter measuring device 16 which measures the diameter of a cross section of the cable 6 substantially perpendicular to the braid axis 5 is arranged anywhere along the braid axis 5 at which the cable 6 is not yet braided and therefore still unshielded. The diameter is thereby preferably measured continuously, although it can also ensue periodically at a specific frequency.

The diameter is measured by means of a suitable measuring means, preferably mechanically, for instance by means of two spring-loaded rollers pressed against two opposite sides of the cable 6 from the outside via spring action. The distance between the two rollers and thus the diameter of the cable 6 can for example be determined by the spring tension with which the two rollers are pushed apart or even by an optical or other measuring range transducer. Further preferentially, the diameter measurement can also ensue on a purely optical basis, for instance by means of a laser sensor, alternatively also by means of a camera which continuously films the passing cable 6, the images of which are evaluated.

The braiding machine 1 can in addition also comprise a (not depicted) measuring device for the twist angle α.

The inventive method is preferably stored in a control device of the braiding machine 1 as control software. When commencing operation, the operator of the braiding machine 1 enters a setpoint for the degree of coverage k into the controller. The diameter D of the cable 6 can also be input into the controller as a setpoint value. Alternatively, the measured diameter D can also be transferred to the controller.

Calculated therefrom—preferably using the mathematical relationship indicated above—is a setpoint $h_{soll}$ for the relative feed rate h of the cable 6; i.e. the distance by which the cable 6 advances during one complete revolution of the upper braiding bobbins 2 or the lower braiding bobbins 3 about the braid axis 5. A $v_{soll,1}$ setpoint is determined from the $h_{soll}$ setpoint for the rotational speed of the upper braiding bobbins 2 or lower braiding bobbins 3 rotation about the braid axis 5 as is a $v_{soll,2}$ setpoint for the haul-off speed of the braided shielded cable 7. To that end, $v_{soll,1}$ is preferably first set to the maximum permissible rotational speed and then $v_{soll,2}=h_{soll}\sim v_{soll,1}$, such that: $h_{soll}=v_{soll,2}/v_{soll,1}$. Should $v_{soll,2}$ then exceed the maximum permissible haul-off speed, both $v_{soll,1}$ as well as $v_{soll,2}$ are reduced at the same rate until $v_{soll,2}$ is also within the permissible range.

The thusly determined $v_{soll,1}$ and $v_{soll,2}$ values are transferred to the respective controller as setpoint values for the rotational speed of the braiding bobbins 2, 3 or the haul-off speed respectively. The respective controller then controls or regulates the rotational speed/haul-off speed to the $v_{soll,1}/v_{soll,2}$ value. This thus thereby ensures that the braided cable 7 substantially exhibits the predefined degree of coverage k.

Should the braiding machine 1 comprise a measuring device for the twist angle α, an $\alpha_{soll}$ setpoint can be calculated—preferably using the mathematical relationship indicated above—for said twist angle α. After that, the rotational speed of the braiding bobbins 2, 3 can be changed and simultaneously the twist angle α measured, e.g. at a constant haul-off speed of the braided cable 7, until the twist angle α has assumed the $\alpha_{soll}$ setpoint value. This thus also ensures that braided cable 7 substantially exhibits the predefined degree of coverage k.

LIST OF REFERENCE NUMERALS

1 braiding machine
2 upper braiding bobbin
3 lower braiding bobbin
4 lower bobbin rail
5 braid axis
6 unshielded cable
7 shielded cable
8 braiding point
9 upper yarn (weft)
10 lower yarn (warp)
11 braiding lever
12 braiding lever pivot bearing
13 braiding lever mount
14 connecting rod for braiding lever control
15 braiding lever cam control
16 diameter measuring device
17 upper braiding bobbin direction of rotation
18 lower braiding bobbin direction of rotation
19 upper inner housing
20 lower inner housing

What is claimed is:

1. A method for operating a braiding, winding or spiraling machine, comprising:

braiding, wrapping or spiraling at least one elongate material strand formed from at least one elongate material fiber around a strand-like material, wherein the at least one elongate material strand is rotationally fixed at least at one point to the strand-like material, the at least one elongate material strand is repeatedly guided around a longitudinal axis of the strand-like material, and the strand-like material is simultaneously moved in a same direction substantially along the longitudinal axis of the strand-like material such that the at least one elongate material strand takes on a shape of a coil looping around the strand-like material, wherein a diameter of a cross section of the strand-like material is measured substantially perpendicular to the longitudinal axis of the strand-like material, and a feed rate of the strand-like material and/or a rotational speed at which the at least one elongate material strand moves around the longitudinal axis of the strand-like material is controlled or regulated as a function of the diameter of the cross section of the strand-like material, and wherein a relative feed rate of the strand-like material, defined as a distance by which the strand-like material moves during one complete revolution of the at least one elongate material strand around the longitudinal axis of the strand-like material, is controlled or regulated as a function of the diameter of the cross section of the strand-like material such that a degree of coverage of the strand-like material by the at least one elongate material strand, defined as a ratio of a total surface area of all of the elongate material strands facing radially outward with respect to the strand-like material covering the strand-like material in a section of the strand-like material to a surface area of the strand-like material in the section, substantially corresponds to a predefined value.

2. The method for operating a braiding, winding or spiraling machine according to claim 1, wherein a $$h = \frac{1}{\sqrt{\left(\frac{k}{fXd}\right)^2 - \frac{1}{(\pi D)^2}}}.$$

relationship is used to control or regulate the relative feed rate of the strand-like material, wherein h is the relative feed rate of the strand-like material, D is the diameter of the cross section of the strand-like material substantially perpendicular to the longitudinal axis of the strand-like material, k is the degree of coverage of the strand-like material by the at least one elongate material strand, f is a number of elongate material fibers in the at least one elongate material strand, d is a diameter of a cross section of an elongate material fiber in the at least one elongate material strand substantially perpendicular to a longitudinal axis of the elongate material fiber, and X is a number of elongate material strands to be factored into the degree of coverage.

3. The method for operating a braiding, winding or spiraling machine according to claim 1, wherein a twist angle, defined as an angle between a half-line running parallel to the longitudinal axis of the strand-like material and opposite to a direction of movement of the strand-like material through a take-up point of the at least one elongate material strand on the strand-like material and the at least one elongate material strand being taken up on the strand-like material, is measured and used in controlling or regulating the relative feed rate of the strand-like material.

4. The method for operating a braiding, winding or spiraling machine according to claim 3, wherein a $$\alpha = \tan^{-1}\sqrt{\left(\frac{k\pi D}{fXd}\right)^2 - 1}.$$

relationship is used to control or regulate the relative feed rate of the strand-like material using the twist angle, wherein α is the twist angle, D is the diameter of the cross section of the strand-like material substantially perpendicular to the longitudinal axis of the strand-like material, k is the degree of coverage of the strand-like material by the at least one elongate material strand, f is a number of elongate material fibers in the at least one elongate material strand, d is a diameter of a cross section of an elongate material fiber in the at least one elongate material strand substantially perpendicular to a longitudinal axis of the elongate material fiber, and X is a number of elongate material strands to be factored into the degree of coverage.

5. A braiding, winding or spiraling machine configured to be operated according to a method for braiding, wrapping or respectively spiraling at least one elongate material strand made from at least one elongate material fiber around a strand-like material, wherein the at least one elongate material strand is rotationally fixed at least at one point to the strand-like material, the at least one elongate material strand is repeatedly guided around a longitudinal axis of the strand-like material, and the strand-like material is simultaneously moved in a same direction substantially along the longitudinal axis of the strand-like material such that the at least one elongate material strand takes on a shape of a coil looping around the strand-like material, wherein a diameter of a cross section of the strand-like material is measured substantially perpendicular to the longitudinal axis of the strand-like material, and a feed rate of the strand-like material and/or a rotational speed at which the at least one elongate material strand moves around the longitudinal axis of the strand-like material is controlled or regulated as a function of the diameter of the cross section of the strand-like material, wherein the braiding, winding or spiraling machine is also configured to repeatedly guide the at least one elongate material strand around the longitudinal axis of the strand-like material and simultaneously move the strand-like material in the same direction substantially along the longitudinal axis of the strand-like material, wherein a measuring apparatus determines the diameter of the cross section of the strand-like material substantially perpendicular to the longitudinal axis of the strand-like material, and a control or regulating apparatus controls or regulates a relative feed rate of the strand-like material, defined as a distance by which the strand-like material moves upon a complete revolution of the at least one elongate material strand around the longitudinal axis of the strand-like material subject to the diameter of the cross section of the strand-like material, and wherein the relative feed rate of the strand-like material is controlled or regulated as a function of the diameter of the cross section of the strand-like material such that a degree of coverage of the strand-like material by the at least one elongate material strand, defined as a ratio of a total surface area of all of the elongate material strands facing radially outward with respect to the strand-like material covering the strand-like material in a section of the strand-like material to a surface area of the strand-like material in the section, substantially corresponds to a predefined value.

6. The braiding, winding or spiraling machine according to claim 5, additionally configured to be operated according to a method wherein a twist angle, defined as an angle between a half-line running parallel to the longitudinal axis of the strand-like material and opposite to a direction of movement of the strand-like material through a take-up point of the at least one elongate material strand on the strand-like material and the at least one elongate material strand being taken up on the strand-like material, is measured and used in controlling or regulating the relative feed rate of the strand-like material, and wherein the braiding, winding or spiraling machine further comprises a measuring device for the twist angle.

7. The braiding, winding or spiraling machine according to claim 6, additionally configured to be operated according to a method wherein a $$\alpha = \tan^{-1}\sqrt{\left(\frac{k\pi D}{fXd}\right)^2 - 1}.$$

relationship is used to control or regulate the relative feed rate of the strand-like material using the twist angle, wherein α is the twist angle, D is the diameter of the cross section of the strand-like material substantially perpendicular to the longitudinal axis of the strand-like material, k is the degree of coverage of the strand-like material by the at least one elongate material strand, f is a number of elongate material fibers in the at least one elongate material strand, d is a diameter of a cross section of an elongate material fiber in the at least one elongate material strand substantially perpendicular to a longitudinal axis of the elongate material fiber, and X is a number of elongate material strands to be factored into the degree of coverage.

* * * * *